US011211193B2

(12) United States Patent
Ku et al.

(10) Patent No.: US 11,211,193 B2
(45) Date of Patent: Dec. 28, 2021

(54) ELECTRONIC COMPONENT

(71) Applicant: SAMSUNG ELECTRO-MECHANICS CO., LTD., Suwon-si (KR)

(72) Inventors: Jin Ho Ku, Suwon-si (KR); Kwi Jong Lee, Suwon-si (KR); Yoon Soo Lee, Suwon-si (KR); Won Joong Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 209 days.

(21) Appl. No.: 16/041,314

(22) Filed: Jul. 20, 2018

(65) Prior Publication Data

US 2019/0252113 A1 Aug. 15, 2019

(30) Foreign Application Priority Data

Feb. 9, 2018 (KR) ..... 10-2018-0016406

(51) Int. Cl.

| | |
|---|---|
| ***H01F 5/00*** | (2006.01) |
| ***H01F 27/29*** | (2006.01) |
| ***H01F 17/00*** | (2006.01) |
| ***H01F 41/04*** | (2006.01) |
| *H01F 17/04* | (2006.01) |

(52) U.S. Cl.

CPC ..... *H01F 27/292* (2013.01); *H01F 17/0013* (2013.01); *H01F 17/0033* (2013.01); *H01F 41/042* (2013.01); *H01F 2017/048* (2013.01)

(58) Field of Classification Search

USPC ..... 336/200

See application file for complete search history.

(56) References Cited

U.S. PATENT DOCUMENTS

| | | | | |
|---|---|---|---|---|
| 2015/0016014 | A1 | 1/2015 | Park et al. | |
| 2016/0225517 | A1* | 8/2016 | Choi | H01F 17/0013 |
| 2016/0351314 | A1* | 12/2016 | Jeong | H01F 27/292 |
| 2018/0096783 | A1* | 4/2018 | Fukuda | H01F 17/04 |
| 2018/0182535 | A1* | 6/2018 | Tachibana | H01F 27/2804 |
| 2018/0182536 | A1* | 6/2018 | Tachibana | H01F 17/0013 |

FOREIGN PATENT DOCUMENTS

| | | | |
|---|---|---|---|
| JP | 2008-166455 | A | 7/2008 |
| JP | 2009-094338 | A | 4/2009 |
| KR | 10-2015-0007581 | A | 1/2015 |

* cited by examiner

*Primary Examiner* — Ronald Hinson

(74) *Attorney, Agent, or Firm* — Morgan, Lewis & Bockius LLP

(57) ABSTRACT

An electronic component includes a magnetic body including a resin and first magnetic powder and having a recess on a lower surface of the magnetic body, an internal coil portion embedded in the magnetic body, and external electrodes disposed on opposing ends of the magnetic body in a length direction of the magnetic body and connected to ends of the internal coil portion, wherein the first magnetic powder disposed on a surface of the recess may have a cut surface.

13 Claims, 8 Drawing Sheets

ELECTRONIC COMPONENT

CROSS-REFERENCE TO RELATED APPLICATION

This application claims the benefit of priority to Korean Patent Application No. 10-2018-0016406 filed on Feb. 9, 2018 in the Korean Intellectual Property Office, the disclosure of which is incorporated by reference herein in its entirety.

TECHNICAL FIELD

The present disclosure relates to an electronic component.

BACKGROUND

An inductor, an electronic component, is a typical passive element constituting an electronic circuit, together with a resistor and a capacitor, to cancel noise.

A thin film type inductor is manufactured by forming an internal coil portion by plating, curing a magnetic powder/resin composite obtained by mixing magnetic powder and a resin to produce a magnetic body, and forming an external electrode on an external surface of the magnetic body.

SUMMARY

An exemplary embodiment of the present disclosure may provide a space in which a molding material (e.g., an epoxy molding compound) may sufficiently permeate between a board and an inductor during packaging.

An exemplary embodiment of the present disclosure may also provide a superior inductor having increased inductance.

According to an exemplary embodiment of the present disclosure, an electronic component may include: a magnetic body including a resin and a first magnetic powder and having a recess on a lower surface of the magnetic body; an internal coil portion embedded in the magnetic body; and external electrodes disposed on opposing ends of the magnetic body in a length direction of the magnetic body and connected to ends of the internal coil portion, wherein the first magnetic powder disposed on a surface of the recess has a cut surface.

According to another exemplary embodiment of the present disclosure, an electronic component may include: a magnetic body including a resin and magnetic powder and having a first region and second regions disposed, in a length direction of the magnetic body, on both sides of the first region, the second regions having a thickness greater than that of the first region in a thickness direction of the magnetic body; an internal coil portion embedded in the magnetic body; and external electrodes disposed on opposing ends of the magnetic body in the length direction of the magnetic body and connected to ends of the internal coil portion, wherein the magnetic powder disposed on a surface of the first region may have a cut surface and a surface of the resin and the cut surface of the magnetic powder are coplanar in the first region.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

In the accompanying drawings, directions W, T and L may denote a width direction, a thickness direction, and a length direction of a chip electronic component, respectively.

Electronic Component

Hereinafter, an electronic component according to an exemplary embodiment in the present disclosure will be described but the present disclosure is not limited thereto.

Figure 1:
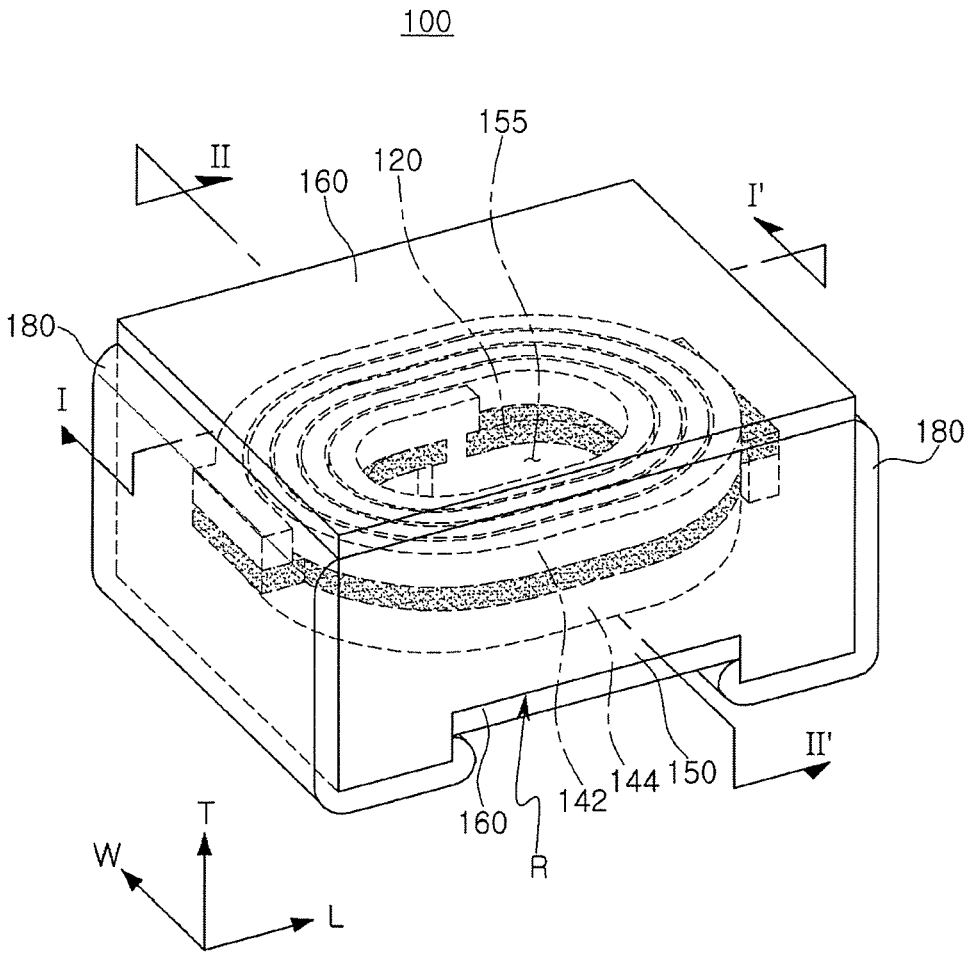
FIG. 1 is a perspective view illustrating an electronic component according to an exemplary embodiment in the present disclosure.
Figure 2:
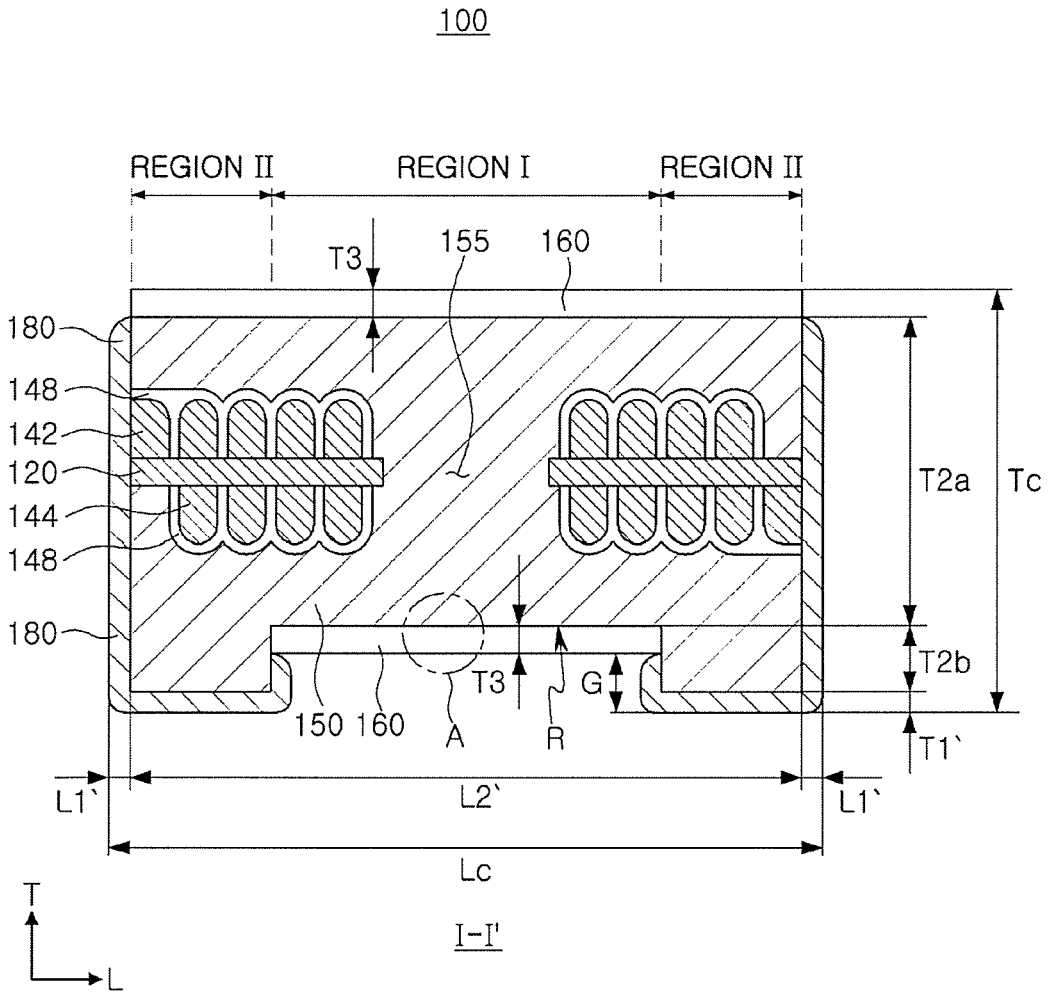
FIG. 2 is a cross-sectional view taken along line I-I' in FIG. 1.
Figure 3:
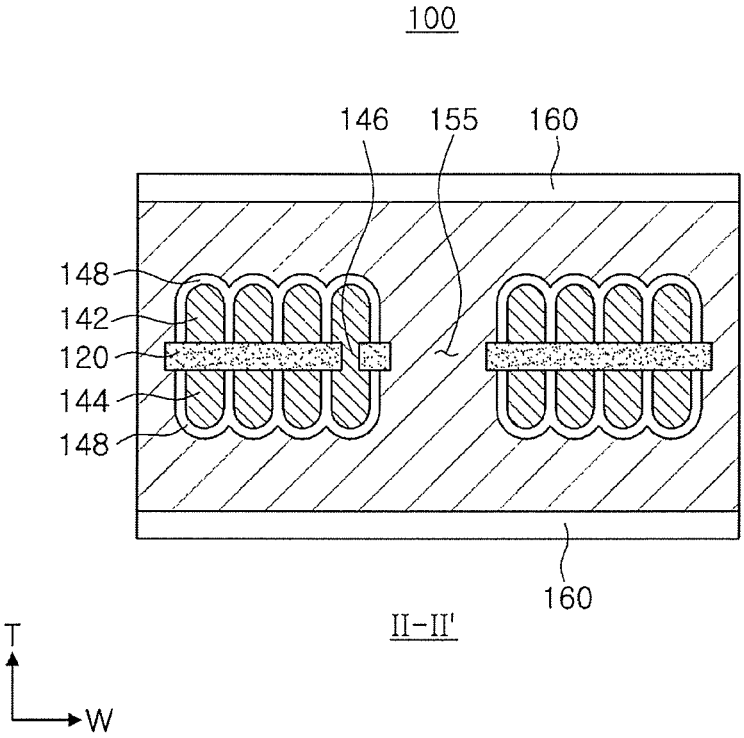
FIG. 3 is a cross-sectional view taken along line II-II' in FIG. 1.

FIG. 1 is a perspective view illustrating an electronic component according to an exemplary embodiment in the present disclosure. FIG. 2 is a cross-sectional view taken along line I-I' in FIG. 1. FIG. 3 is a cross-sectional view taken along line II-II' in FIG. 1.

Referring to FIGS. 1 to 3, a thin film type inductor for use in a power line of a power supply circuit is illustrated as an example of an electronic component 100.

The electronic component 100 according to an exemplary embodiment in the present disclosure includes a magnetic body 150, first and second internal coil portions 142 and 144 embedded in the magnetic body 150, insulating layers 160 disposed on an upper surface of the magnetic body 150 and on a recess R of a lower surface of the magnetic body 150, and external electrodes 180 disposed outside the magnetic body 150 and electrically connected to the first and second internal coil portions 142 and 144.

The magnetic body 150 includes first magnetic powder. The first magnetic powder is not limited as long as it exhibits magnetic properties, and may be formed of, for example, ferrite. The ferrite may be, for example, Mn—Zn-based ferrite, Ni—Zn-based ferrite, Ni—Zn—Cu-based ferrite, Mn—Mg-based ferrite, Ba-based ferrite, Li-based ferrite, and the like. The first magnetic powder may be an alloy including at least one selected from the group consisting of Fe, Si, Cr, Al, B, and Cu, and may include, for example, Fe—Si—B—Cr-based amorphous metal particles but is not limited thereto.

The first magnetic powder may be dispersed in a thermosetting resin such as an epoxy resin, an acryl resin, or a polyimide resin.

The magnetic body 150 includes the first magnetic powder and the thermosetting resin.

The magnetic body 150 has a recess R on a lower surface thereof. A width of the recess R is equal to a width of the magnetic body 150. A length of the recess R is smaller than a length of the magnetic body 150.

The magnetic body 150 may be divided into a first region ('REGION I' in FIG. 2) in which the recess R is formed and second regions ('REGION II' in FIG. 2) disposed on both sides of the first region in the length direction. A thickness of the second regions is greater than a thickness T2*a* of the first region in the thickness direction. A difference in thickness between the second regions and the first region is equal to a depth T2*b* of the recess R from the lower surface of the magnetic body 150.

The insulating layers 160 may be disposed on the upper surface of the magnetic body 150 and on the recess R of the lower surface of the magnetic body 150 to prevent or reduce occurrence of plating spread phenomenon when the external electrodes are formed through follow-up plating. The insulating layer 160 may cover the entire upper surface of the magnetic body 150. The insulating layer 160 may not be formed on the lower surface except the recess R. The insulating layer 160 may include second magnetic powder. The second magnetic powder may be formed of the same material as the first magnetic powder. Including the second magnetic powder, the insulating layer 160 not only prevents or reduces plating spread phenomenon but also contributes to formation of inductance. A thickness T3 of the insulating layer 160 may be smaller than the depth T2*b* of the recess R.

Figure 8:
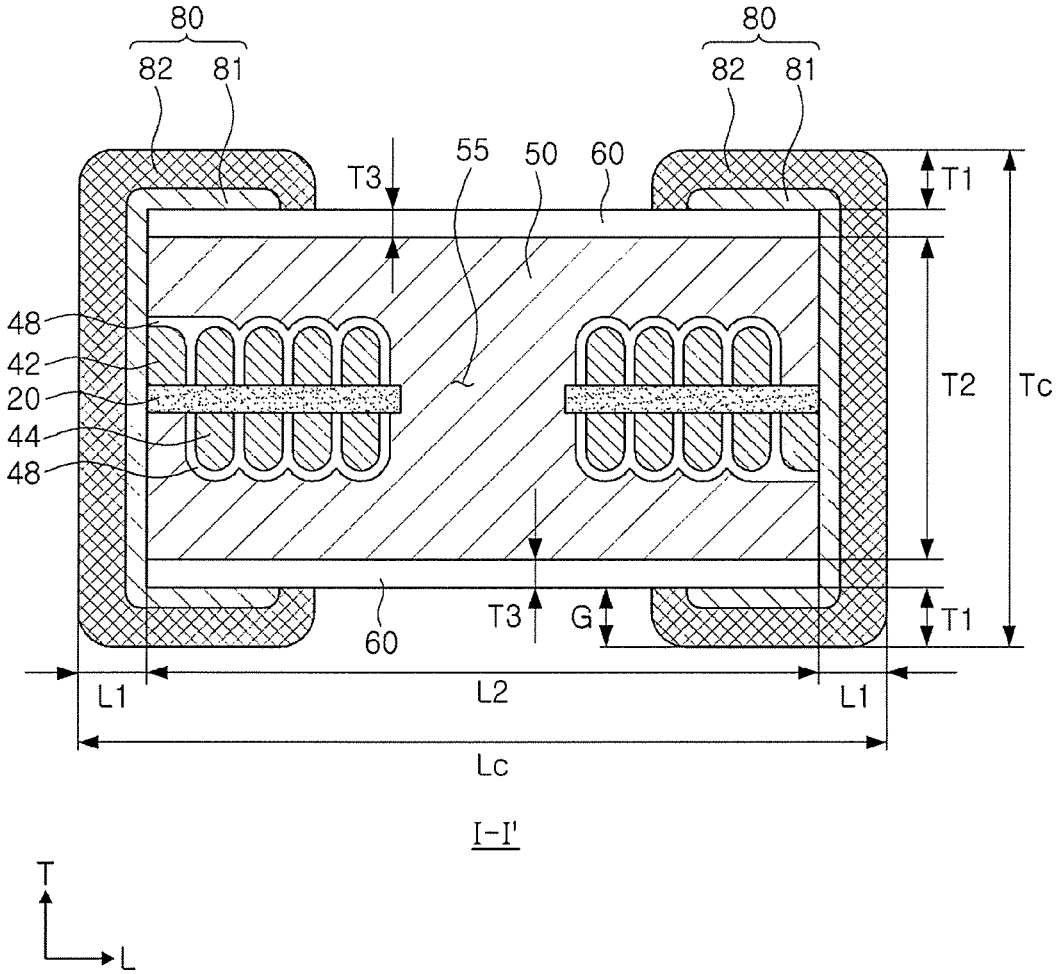
RELATED ART FIG. 8
FIG. 8 is a cross-sectional view taken along line I-I' of FIG. 7.

The external electrodes 180 are formed on opposing end surfaces of the magnetic body 150 in the length direction. The external electrodes 180 may be formed of a conductive metal having excellent electrical conductivity. For example, the external electrodes 180 may be formed of nickel (Ni), copper (Cu), tin (Sn), or a combination thereof. The external electrodes 180 have an L shape and cover the lower surfaces of the second regions of the magnetic body 150. The external electrodes 180 are not formed on the upper surface of the magnetic body 150. Therefore, the thickness T2*a* of the first region of the magnetic body 150 is larger by the thickness T1 of the external electrode 80 than a thickness T2 of a magnetic body 50 of FIG. 8 representing the related art electronic component (inductor). A thickness T1' of the external electrode 180 is smaller than a thickness T1 of the external electrode 80 in FIG. 8. The thickness T1' of the external electrode 180 may be smaller than the depth T2*b* of the recess R. Since the external electrode 180 formed through plating is uniform in thickness in all directions due to the characteristics of the plating and the thickness T1' of the external electrode 180 is smaller than the thickness T1 of the external electrode 80 in FIG. 8, a length L2' of the magnetic body 150 may be greater than a length L2 of the magnetic body 50 of FIG. 8. In FIG. 2, a thickness L1' of the external electrode 180 in the length direction is equal to the thickness T1' in the thickness direction, and a thickness L1 in the length direction of the external electrode 80 in FIG. 8 may be equal to the thickness T1 in the thickness direction.

Figure 7:
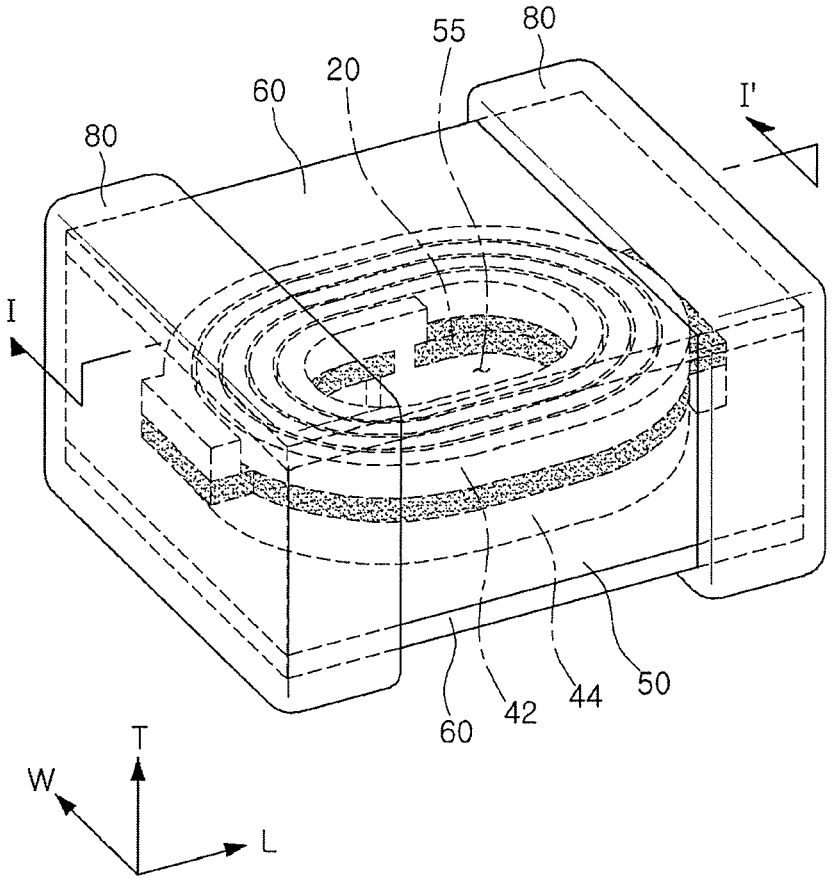
RELATED ART FIG. 7
FIG. 7 is a perspective view illustrating a related art electronic component.

The related art electronic component (inductor) is as shown in FIGS. 7 and 8. The related art electronic component (inductor) includes a magnetic body 50, first and second internal coil portions 42 and 44 embedded inside the magnetic body 50, insulating layers 60 disposed on an upper surface and a lower surface of the magnetic body 50, and external electrodes 80 disposed outside the magnetic body 50 and electrically connected to the first and second internal coil portions 42 and 44.

The external electrodes 80 are formed on opposing end surfaces of the magnetic body 50 in the length direction and are formed on the upper and lower surfaces of the magnetic body 50. The external electrodes 80 cover a portion of the insulating layer 60 formed on the upper and lower surfaces of the magnetic body 50. The external electrode 80 may include an external electrode layer 81 formed using a conductive paste and a plating layer 82 formed on the external electrode layer 81 through plating. The external electrode layer 81 may be a conductive resin layer including at least one conductive metal selected from the group consisting of copper (Cu), nickel (Ni), and silver (Ag) and a thermosetting resin. The plating layer 82 may include at least one selected from the group consisting of nickel (Ni), copper (Cu), and tin (Sn). For example, a Cu layer, a Ni layer, and a Sn layer may be sequentially formed.

As electronic devices have increasingly had high performance and been multi-functional and miniaturized, the number of components increases, and thus, a method of packaging ICs and passive elements into a single module has been sought to reduce a mounting area. Also, since electronic components (inductors) used in such miniaturized electronic devices are also required to be smaller and thinner, the electronic components (inductors) have a limited size such as a limited chip thickness Tc and a limited chip length Lc. In order to allow a molding material (e.g., an epoxy molding compound) to sufficiently permeate between a circuit board and the electronic component (inductor) during packaging, a predetermined gap is required between the electronic component (inductor) and the circuit board. To this end, in the related art, a vertical distance G from a surface of the insulating layer 60 to a lower surface of the external electrode 80 is formed to have a desired value (e.g., at least 5 μm) by forming the thick external electrodes 80 having a thickness T1. In order to form the external electrodes 80 to be thick, while satisfying the limited size of the electronic component (inductor), the thickness T2 of the magnet body 50 is inevitably reduced. That is, the volume of the magnetic body 50 is inevitably reduced, instead of forming the external electrode 80 to be thick. This leads to a degradation of the characteristics of the inductor.

According to the present exemplary embodiment as shown in FIGS. 1 to 3, while maintaining the same size (chip thickness Tc and chip length Lc, etc.) as that of the related art electronic component (inductor), the volume of the magnetic body may be increased and a vertical distance G from the surface of the insulating layer 160 to the lower surface of the external electrode 180 may have a desired value (for example, a minimum of 5 μm or greater). Accordingly, an excellent electronic component (inductor) with increased inductance may be obtained, while satisfying the physical conditions required for electronic component (inductors) when an IC and a passive component are packaged into a single module.

The first internal coil portion 142 having a coil-shaped pattern is formed on one surface of a base layer 120 disposed inside the magnetic body 150, and the second internal coil portion 144 having a coil-shaped pattern is formed on the opposite side of the base layer 120.

The base layer 120 is formed of, for example, a polypropylene glycol (PPG) substrate, a ferrite substrate, a metal-based soft magnetic substrate, or the like.

A central portion of the base layer 120 is penetrated to form a hole, and the hole is filled with the first magnetic powder to form a core portion 155. Inductance may be improved by forming the core portion 155 filled with the first magnetic powder.

The first and second internal coil portions 142 and 144 may have a spiral shape and may be formed on the opposite surfaces of the base layer 120. The coil portions 142 and 144 are electrically connected to each other via a via electrode 146 penetrating through the base layer 120.

The first and second internal coil portions 142 and 144 and the via electrode 146 may be formed of a metal having excellent electrical conductivity, for example, silver (Ag), palladium (Pd), aluminum (Al), nickel (Ni), titanium (Ti), gold (Au), copper (Cu), platinum (Pt), or alloys thereof.

The first and second internal coil portions 142 and 144 may be covered with an insulating layer 148. The insulating layer 148 may be formed by a known method such as a screen printing method, a process through exposure and development of photoresist (PR), a spray coating process, or the like. The first and second internal coil portions 142 and 144 may be covered with the insulating layer 148 and may not be in direct contact with the magnetic material included in the magnetic body 150.

One end of the first internal coil portion 142 formed on one side of the base layer 120 may be exposed to one end surface of the magnetic body 150 in the length direction, and one end of the second internal coil portion 144 formed on the opposite side of the base layer 120 may be exposed to the other end surface of the magnetic body 150 in the length direction.

The external electrodes 180 are formed on the opposing end surfaces in the length direction and connected to the first and second internal coil portions 142 and 144 exposed at the opposing end surfaces of the magnetic body 150 in the length direction.

Figure 4:
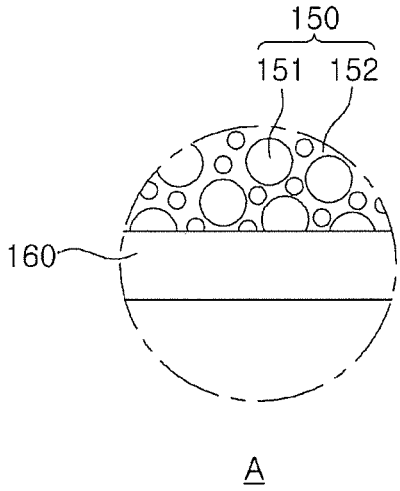
FIG. 4 is an enlarged schematic view illustrating an exemplary embodiment of a portion 'A' of FIG. 2.

FIG. 4 is a schematic enlarged view of an exemplary embodiment of a portion 'A' of FIG. 2.

Referring to FIG. 4, the magnetic body 150 includes first magnetic powder 151 and a resin 152. The first magnetic powder 151 positioned on a surface of the recess R may have a flat cut surface. In the recess R, a surface of the resin 152 and the cut surface of the first magnetic powder 151 may be coplanar. A particle size distribution D50 of the first magnetic powder 151 may be 0.1 μm to 25 μm, which is measured using a particle diameter and particle size distribution measuring apparatus using a laser diffraction scattering method. The particle diameter of the first magnetic powder 151 may be 0.1 μm to 50 μm.

Method of Manufacturing Electronic Component

Figure 5:
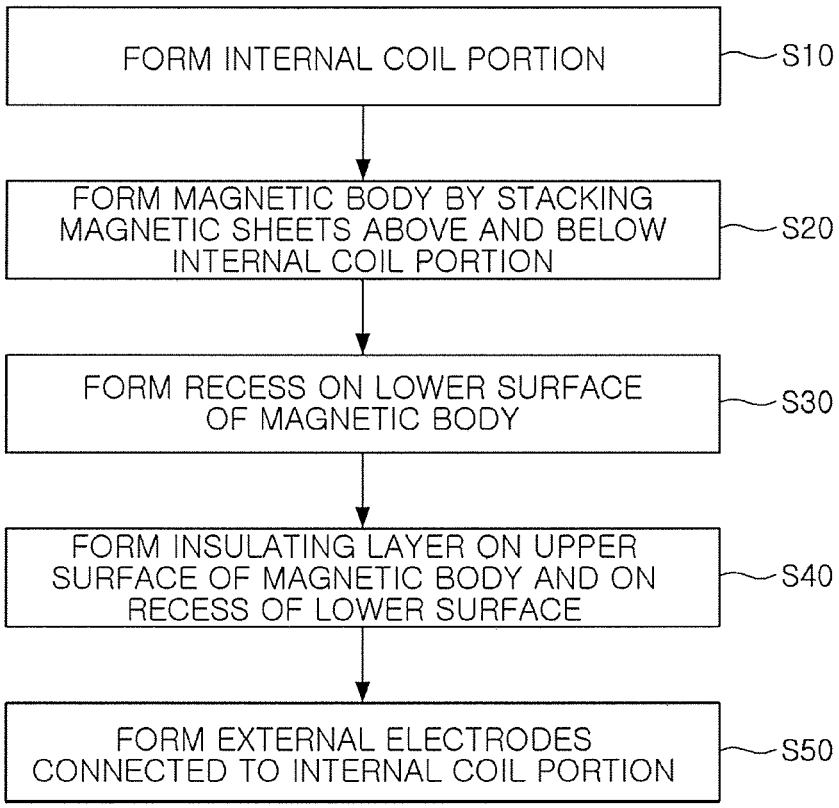
FIG. 5 is a flowchart illustrating a process of manufacturing an electronic component according to an exemplary embodiment in the present disclosure.

FIG. 5 is a flowchart illustrating a process of manufacturing an electronic component according to an exemplary embodiment in the present disclosure. FIGS. 6A through 6D are views sequentially illustrating a process of manufacturing an electronic component according to an exemplary embodiment in the present disclosure. The process is for manufacturing a plurality of electronic components, but FIGS. 6A to 6D illustrate a single electronic component.

Figure 6A:
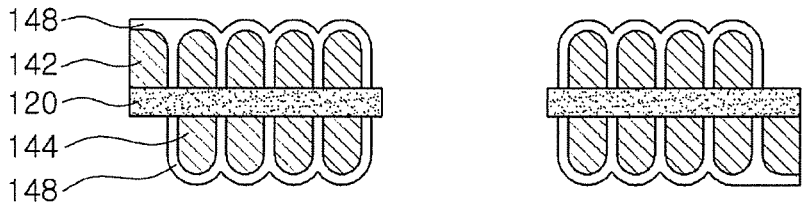
FIGS. 6A through 6D are views sequentially illustrating a process of manufacturing an electronic component according to an exemplary embodiment in the present disclosure.

Referring to FIGS. 5 and 6A, the first and second internal coil portions 142 and 144 are formed on one surface and the opposite surface of the base layer 120 in operation S10.

The method of forming the first and second internal coil portions 142 and 144 may be, for example, an electroplating method, but is not limited thereto. The first and second internal coil portions 142 and 144 may be formed of a metal having excellent electrical conductivity and, for example, a material such as silver (Ag), palladium (Pd), aluminum (Al), nickel (Ni), titanium (Ti), gold (Au), copper (Cu), platinum (Pt), or alloys thereof may be used.

The insulating layer 148 may be formed on the surfaces of the first and second internal coil portions 142 and 144. The insulating layer 148 may be formed by a known method such as a screen printing method, a process through exposure and development of photoresist (PR), a spray coating process, or the like.

Figure 6B:
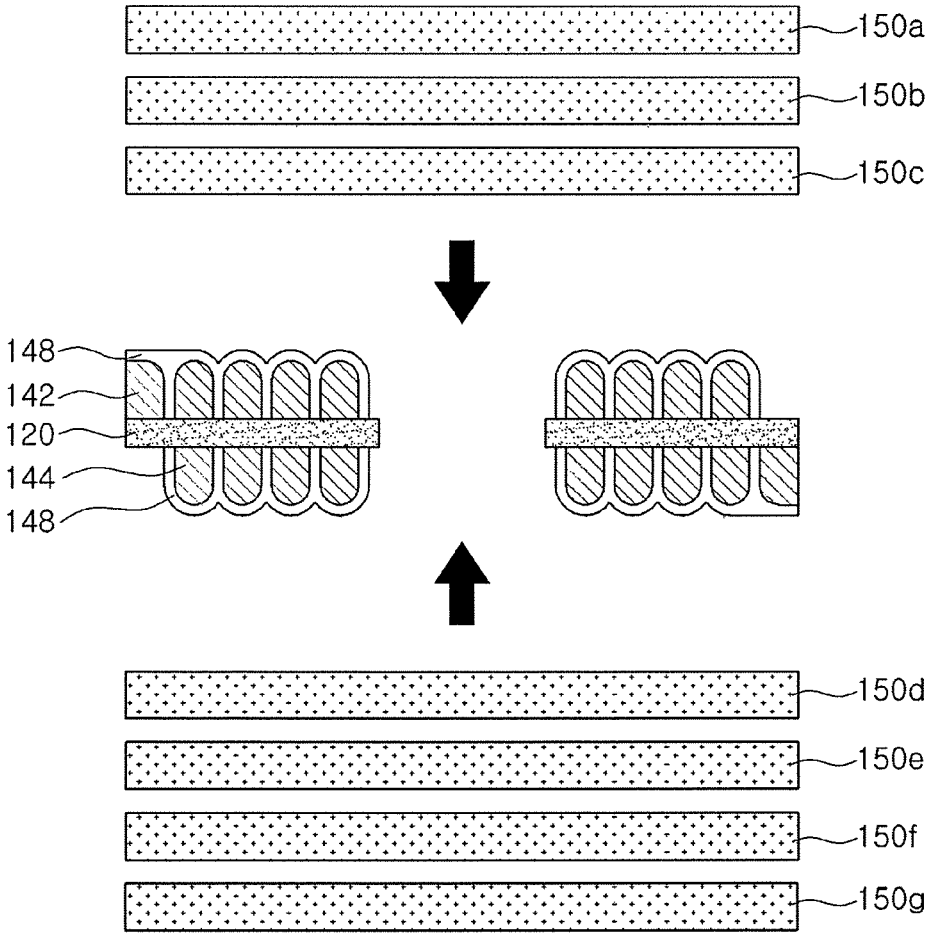

Referring to FIGS. 5 and 6B, a plurality of magnetic sheets 150*a*, 150*b*, 150*c*, 150*d*, 150*e*, 150*f*, and 150*g* are stacked above and below the first and second internal coil portions 142 and 144 to form the magnetic body 150 in operation S20.

The plurality of magnetic sheets 150*a*, 150*b*, 150*c*, 150*d*, 150*e*, 150*f*, and 150*g* may be prepared by mixing the first magnetic powder with an organic material such as a binder, a solvent, and the like, to prepare slurry, applying the slurry to a carrier film through a doctor blade method to have a thickness of tens of μm and drying the same, for example.

After the plurality of magnetic sheets 150*a*, 150*b*, 150*c*, 150*d*, 150*e*, 150*f*, and 150*g* are stacked, the plurality of stacked magnetic sheets 150*a*, 150*b*, 150*c*, 150*d*, 150*e*, 150*f*, and 150*g* may be compressed through a lamination method or a hydrostatic pressure method and cured to form the magnetic body 150. The magnetic body 150 may include a resin and the first magnetic powder dispersed in the resin.

Figure 6C:
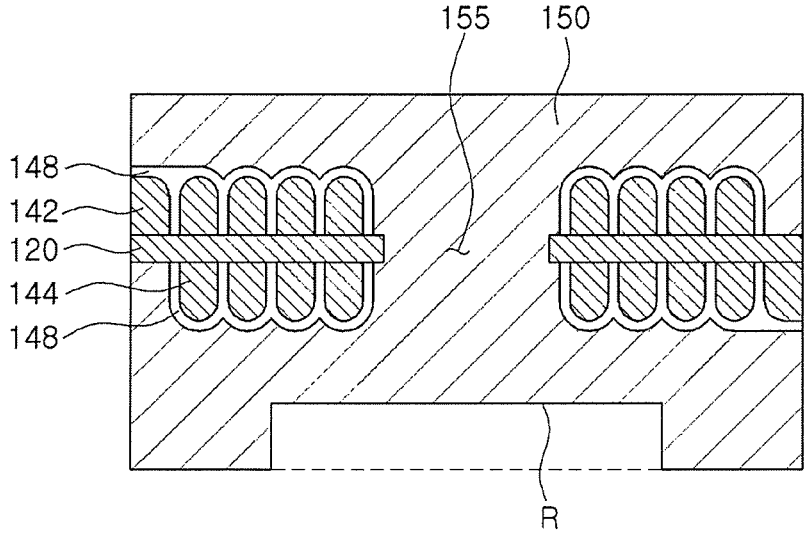

Referring to FIGS. 5 and 6C, the recess R is formed on a lower surface of the magnetic body 150 in operation S30.

The recess R may be formed in a central portion of the lower surface of the magnetic body 150 by removing a portion of the magnetic body 150 through a dicing process. Since the magnetic powder of the magnetic body 150 and the resin are removed together by a blade, the magnetic powder positioned on the surface of the recess R has a flat cut surface. In the recess R, the cut surface of the magnetic powder and the surface of the resin may be coplanar.

Figure 6D:
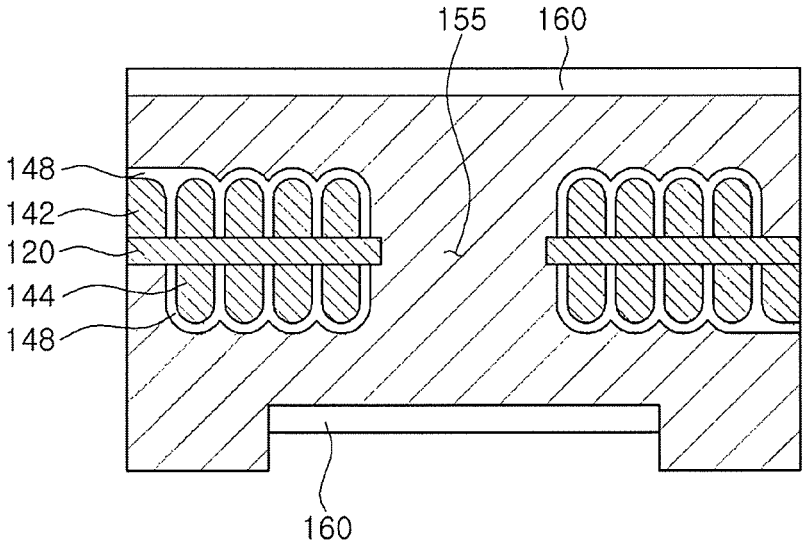

Referring to FIGS. 5 and 6D, the insulating layer 160 is formed on the entire upper surface of the magnetic body 150 and on the recess R in operation S40.

The insulating layer 160 may prevent or reduce plating spread phenomenon when an external electrode is formed through plating. The insulating layer 160 may be formed using, for example, an epoxy resin. That is, the insulating layer 160 may be formed using insulating paste including an epoxy resin. The insulating layer 160 may include the second magnetic powder, and the insulating layer 160 may have an epoxy resin content of 30 to 60 vol %.

Referring back to FIG. 2, the external electrodes 180 are formed to be connected to the ends of the first and second internal coil portions 142 and 144 exposed to both end surfaces of the magnetic body 150 in the length direction in operation S50.

The external electrodes 180 may be formed through plating. The plating includes electrolytic plating, electroless plating, and the like.

For example, the external electrodes 180 may be formed by sequentially forming a copper (Cu) layer, a nickel (Ni), and a tin (Sn) layer.

As set forth above, according to exemplary embodiments of the present disclosure, since the volume of the magnetic body is increased, an excellent inductor having increased inductance may be provided.

According to an exemplary embodiment in the present disclosure, a space in which a molding material (e.g., an epoxy molding compound) may sufficiently permeate between the board and the inductor during packaging may be provided.

While exemplary embodiments have been shown and described above, it will be apparent to those skilled in the art that modifications and variations could be made without departing from the scope of the present disclosure as defined by the appended claims.

What is claimed is:

1. An electronic component comprising:

a magnetic body including a resin and first magnetic powder and having a recess on a lower surface of the magnetic body;

an internal coil portion embedded in the magnetic body; and external electrodes respectively disposed on opposing ends of the magnetic body in a length direction of the magnetic body and connected to corresponding ends of the internal coil portion at the opposing ends, wherein at least one of the external electrodes includes a portion arranged in the recess, wherein an insulating layer is disposed on an entire upper surface of the magnetic body and on the recess, and wherein thicknesses of the external electrodes are thinner than a depth of the recess.

2. The electronic component of claim 1, wherein the first magnetic powder disposed on a surface of the recess has a cut surface.

3. The electronic component of claim 1, wherein a width of the recess is equal to a width of the magnetic body.

4. The electronic component of claim 1, wherein the insulating layer further includes second magnetic powder.

5. The electronic component of claim 1, wherein a thickness of the insulating layer is thinner than the depth of the recess.

6. The electronic component of claim 1, wherein the external electrodes cover the lower surface outside the recess.

7. The electronic component of claim 1, wherein at least one of the external electrodes is formed of nickel (Ni), copper (Cu), tin (Sn), or alloys thereof.

8. An electronic component comprising:

a magnetic body including a resin and magnetic powder and having a first region and second regions disposed, in a length direction of the magnetic body, on both sides of the first region, the second regions having a thickness greater than that of the first region in a thickness direction of the magnetic body;

an internal coil portion embedded in the magnetic body; and external electrodes respectively disposed on opposing ends of the magnetic body in the length direction of the magnetic body and connected to corresponding ends of the internal coil portion at the opposing ends, wherein at least one of the external electrodes includes a portion arranged in the first region, wherein an insulating layer is disposed on an entire upper surface of the magnetic body, and wherein the upper surface of the magnetic body is devoid of the external electrodes.

9. The electronic component of claim 8, wherein the magnetic body has a recess on a lower surface thereof.

10. The electronic component of claim 9, wherein a difference in thickness between the second regions and the first region is equal to a depth of the recess from the lower surface of the magnetic body.

11. The electronic component of claim 9, wherein the external electrodes cover the lower surface outside the recess.

12. The electronic component of claim 2, wherein a surface of the resin and the cut surface of the first magnetic powder are coplanar in the recess.

13. The electronic component of claim 8, wherein the magnetic powder disposed on a surface of the first region has a cut surface and a surface of the resin and the cut surface of the magnetic powder are coplanar in the first region.

* * * * *